US006606829B2

(12) United States Patent
Benincasa et al.

(10) Patent No.: US 6,606,829 B2
(45) Date of Patent: Aug. 19, 2003

(54) LAND ANCHOR

(76) Inventors: Frank Benincasa, 4975 Reiter Ave., Las Vegas, NV (US) 89108; Beneditto Cafaro, 8538 Brownstone Ct., Las Vegas, NV (US) 89139

( * ) Notice: Subject to any disclaimer, the term of this patent is extended or adjusted under 35 U.S.C. 154(b) by 0 days.

(21) Appl. No.: 09/838,505

(22) Filed: Apr. 19, 2001

(65) Prior Publication Data

US 2003/0084620 A1 May 8, 2003

(51) Int. Cl.[7] ..... E02D 5/74

(52) U.S. Cl. ..... 52/155; 52/156; 52/166; 114/293; 114/294; 114/295; 114/230.16; 119/786; 135/118; 173/91; 173/128

(58) Field of Search ..... 52/155, 156, 157, 52/166; 114/293, 294, 295, 230.16; 119/786; 405/232; 135/118; 173/90, 91, 128, 129

(56) References Cited

U.S. PATENT DOCUMENTS

| | | | | | |
|---|---|---|---|---|---|
| 299,086 | A | * | 5/1884 | Over | 52/162 |
| 722,531 | A | | 3/1903 | McGoron | |
| 3,117,378 | A | | 1/1964 | Bowen | |
| 3,774,361 | A | * | 11/1973 | Tanner | 52/162 |
| 3,896,769 | A | | 7/1975 | McGehee | |
| 4,040,214 | A | | 8/1977 | Frye | |
| 4,459,787 | A | * | 7/1984 | Wilcox | 52/155 |
| 4,470,440 | A | | 9/1984 | Thor | |
| 4,756,128 | A | | 7/1988 | Danieli | |
| 4,960,064 | A | | 10/1990 | Mestas et al. | |
| 4,971,479 | A | | 11/1990 | Byers, Sr. et al. | |
| 5,613,458 | A | * | 3/1997 | Owen | 52/155 |
| 2002/0007775 | A1 | | 1/2002 | Woyjeck | |

FOREIGN PATENT DOCUMENTS

| | | | | |
|---|---|---|---|---|
| DE | 3326428 A1 | * | 7/1985 | E21D/21/00 |
| JP | 4-27012 | * | 5/1990 | E02D/5/80 |
| WO | WO 92/02406 | * | 7/1991 | B63B/21/54 |

* cited by examiner

*Primary Examiner*—Carl D. Friedman
*Assistant Examiner*—Chi Q. Nguyen
(74) *Attorney, Agent, or Firm*—Sullivan Law Group

(57) ABSTRACT

The collapsible land anchor of this invention includes an anchor body, a drive anvil coupled to the top end portion of the anchor body, and a runner member that is slidable longitudinally through the drive anvil between an operative position and a collapsed position. A retraction anvil is coupled to the top end portion of the runner member, and a hammer weight is carried on the runner member. In its operative position, the runner member extends beyond the drive anvil away from the cavity of the anchor body to space the drive anvil apart from the retraction anvil. Also in the operative position, the hammer weight is slidable along the runner member into the drive anvil to drive the anchor body into the ground. In the collapsed position, the runner member is displaced towards and at least partially stowed in the cavity of the anchor body.

24 Claims, 3 Drawing Sheets

LAND ANCHOR

BACKGROUND OF THE INVENTION

1. Field of the Invention

This invention relates to the field of anchors, and in particular is directed to land anchors that may be driven into the earth, or other stationary or stable objects. This invention is particularly useful for use as a land anchor for tethering boats or other water-borne objects and land-borne objects, and methods of use of the land anchor.

2. Description of Related Art

Anchors are well known in the art for securing a vessel to a seabed. The Fisherman's anchor, Danforth anchor, Bruce anchor, and folding grapnel are just a few of the many types of anchors known for seabed anchoring. A mooring line or rode connects the anchor to the vessel. When lowered onto the seabed, the anchors and mooring line function to retain the vessel in its desired location and prevent drifting of the vessel far from the desired location.

Smaller vessels, such as sailboats and small yachts, often rely shore-docking devices for inhibiting drifting and permitting ingress and egress to and from the vessel. Most commonly, smaller vessels use a rope or multiple ropes for tying to docks.

It is often the case, however, that boaters wish to dock their vessels at locations lacking conventional boat docking facilities, such as in the event that the boater wishes to partake in sunbathing at a beach or hiking at the shore, for instance. On such occasions, shore anchors are commonly used for preventing the vessel from floating away while removing the need to put the vessel aground.

Examples of land anchors are disclosed in U.S. Pat. No. 4,960,064 to Mestas and U.S. Pat. No. 5,613,458 to Owen. Each of these land anchors has a unitary elongated spike-like anchor rod extending the length of the anchor. A hammer element is captured on the anchor rod to slide between two anvils along a portion of the anchor rod length. In order to secure the anchor to the ground, the pointed lower end of the anchor rod is placed in contact with the ground and the hammer element is repeatedly slid between the anvils into striking engagement with the lower of the two anvils, also known as the drive anvil. Each time the hammer element strikes the drive anvil, the anchor rod is driven further into the ground. Opposite ends of a rode are tied to the vessel and the embedded anchor, respectively, to secure the vessel.

One problem associated with conventional land anchors is their poor stowability. Conventional land anchors often have lengths as great as about four feet. On small ships, where room may be very limited and space cramped, there is great desire to maximize available space. Accordingly, it would be an improvement in the art to provide a land anchor which has sufficient length to permit repeated striking movement of a captured hammer along a shaft of the anchor, yet which requires less stowage space during storage than conventional land anchors.

OBJECTS OF THE INVENTION

It is therefore one of the objects of this invention to provide a land anchor that is collapsible into a compact state to facilitate its stowage, especially stowage on a boat.

It is another object of this invention to provide a boat that either carries or is docked with the land anchor of this invention.

It is a further object of this invention to provide a method of using the land anchor of this invention to dock a boat to the earth or other stationary or stable objects, or the like.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in the appended claims.

SUMMARY OF THE INVENTION

To achieve foregoing objects, and in accordance with the purposes of the invention as embodied and broadly described in this document, a collapsible land anchor is provided. According to an aspect of the invention, the collapsible land anchor comprises an anchor body having a tapered bottom end portion and a top end portion. The anchor body is provided with a cavity extending longitudinally between the tapered bottom end portion and the top end portion. A drive anvil is coupled to the top end portion of the anchor body. The collapsible land anchor further comprises a runner member slidable longitudinally across the drive anvil between an operative position and a collapsed position. A retraction anvil is coupled to the top end portion of the runner member. A hammer weight is carried on and preferably captured by the runner member.

In its operative position, at least a portion of the length of the runner member extends beyond the drive anvil away from the cavity of the anchor body to space the drive anvil apart from the retraction anvil. A locking mechanism is provided for locking the runner member in the operative position. The hammer weight is capable of sliding along the runner member between the drive anvil and the retraction anvil when the runner member is in the operative position. By repeatedly striking the hammer weight into the drive anvil, the anchor body may be driven into the ground or other stationary bodies. By pulling or striking the hammer weight against the retraction anvil with sufficient force, the anchor body may be dislodged from the ground. The locking member is capable of being disengaged to allow movement of the runner member towards the anchor body and into the collapsed position, in which at least a portion of the length of the runner member is stowed in the cavity of the anchor body. Preferably, the locking member is capable of being re-engaged for locking the runner member in the collapsed position.

In accordance with another aspect of the invention, a boat is provided which carries or is docked with the land anchor of this invention. Preferably, but optionally, a rode, such as a mooring or tether, is used to interconnect the boat to the land anchor.

In accordance with still another aspect of the invention, a method is provided for docking a boat to the land or a stationary or stable body, such as a dock or the like with the use of the land anchor of this invention.

In accordance with a further aspect of this invention, there is provided a novel rode-tying member that may be used with a collapsible or non-collapsible land anchor.

Additional objects and advantages of the invention will be set forth in the description of the preferred embodiments and methods that follows, and in part will be apparent from the description, or may be learned by practice of the invention. The objects and advantages of the invention may be realized and obtained by means of the instrumentalities and combinations pointed out in the appended claims.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings.

DETAILED DESCRIPTION OF PREFERRED EMBODIMENTS AND METHODS OF THE INVENTION

Reference will now be made in detail to the presently preferred embodiments and methods of the invention as described below. It should be noted, however, that the invention in its broader aspects is not limited to the specific details, representative devices and methods, and examples described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise. Thus, by way of example, the term "collar" includes in its definition a combination of two or more collars, for example.

As referred to herein, the term "land" is sued in its common but broad sense to include not only earthen materials, e.g., such as dirt, sand, beach terrain, clay, and the like, but also to stationary or stable objects that are suited for receiving and securing anchors according to the various aspects of the invention. The term "land" also may include submerged materials, such as sea bed, river bed, lake bed, silted areas, marshes, and the like. Also as referred to herein, the term "boat" is used in its common but broad usages to include such items as ships, yachts, catamarans, crafts, sailboats, barges, and other flotation vessels, especially those capable of carrying one or more persons.

Figure 6:
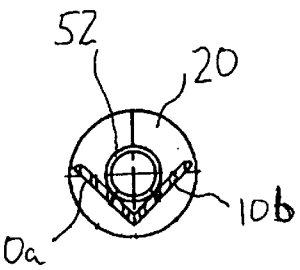
FIG. 6 is an end sectional view taken along sectional VI—VI of FIG. 4.

Referring now more particularly to the drawings, there is shown a land anchor in accordance with one preferred embodiment of this invention. The land anchor comprises an anchor body 10. In the illustrated embodiment, the anchor body 10 comprises an angle iron defined by angled walls 10*a* and 10*b* (FIG. 6), which are symmetrical to each other and joined along a common side edge to define a V-shaped cross section. The V-shape of the cross section of the anchor body 10 is best seen in FIG. 6. The anchor body 10 extends from a tapered bottom end portion 12 to a top end portion 14. In the illustrated embodiment, the tapered bottom end portion 12 is truncated for safety reasons. It should be understood, however, that the tapered bottom end portion 12 may extend into a point or apex, although not shown in the various figures.

The anchor body 10 may be comprised of, for example, a metal or metal alloy, such as aluminum or steel, or other material or combinations of material having sufficient strength to withstand the stress of being driven into the earth.

Positioned between the tapered bottom end portion 12 and the top end portion 14 is an open cavity 16, which in the illustrated embodiment has an inverted pyramid (or triangular) cross section. Although the cavity 16 is shown extending longitudinally from the tapered bottom end portion 12 to the top end portion 14, it should be understood that as used herein the term "between" also means that the cavity 16 may be intermediate to, but not coextensive with, the tapered bottom end portion 12 and the top end portion 14.

A drive anvil 20 is coupled to the top end portion 14 of the anchor body 10. Preferably, coupling is achieved by welding or otherwise permanently affixing the drive anvil 20 to the anchor body 10. It is possible, however, to couple the drive anvil 20 to the anchor body 10 in a removable fashion. In the illustrated embodiment, the drive anvil 20 is a heavy duty washer having an aperture 22. Although illustrated as a circular hole, the aperture 22 can undertake other configurations, such as polygonal. Alternatively, the aperture 22 may be shaped in the form of an open groove in the drive anvil 20.

The drive anvil 20 is preferably, although not necessarily, comprised of the same material as the anchor body 10, and should have sufficient strength to withstand the stress of operation, which is described in more detail below.

A runner member 30, a hammer weight 32, and a retraction anvil 40 are provided for the purpose of driving the anchor body 10 into and dislodging the anchor body 10 from the ground, docking body, or the like. The runner member 30 is illustrated as an elongated rod having the retraction anvil 40 coupled to its distal end. The retraction anvil 40 may be permanently affixed to the runner member 30 by welding, or may be removable to permit separation of the hammer weight 32 from the runner member 30. In order to reduce the overall weight of the land anchor, the runner member 30 may be a hollow tube. Although not shown, the runner member 30 may also have a polygonal or non-circular cross section, although the outer peripheral surface of the runner member 30 will preferably be complementary to the shape and size of the aperture 22 of the drive anvil 20. Suitable materials of which the runner member 30 and retraction anvil 40 may be comprised include metals and alloys, such as aluminum and stainless steel, although other material and combinations of material may be used. In the illustrated embodiment the retraction anvil 40 is a heavy duty washer.

Figure 1:
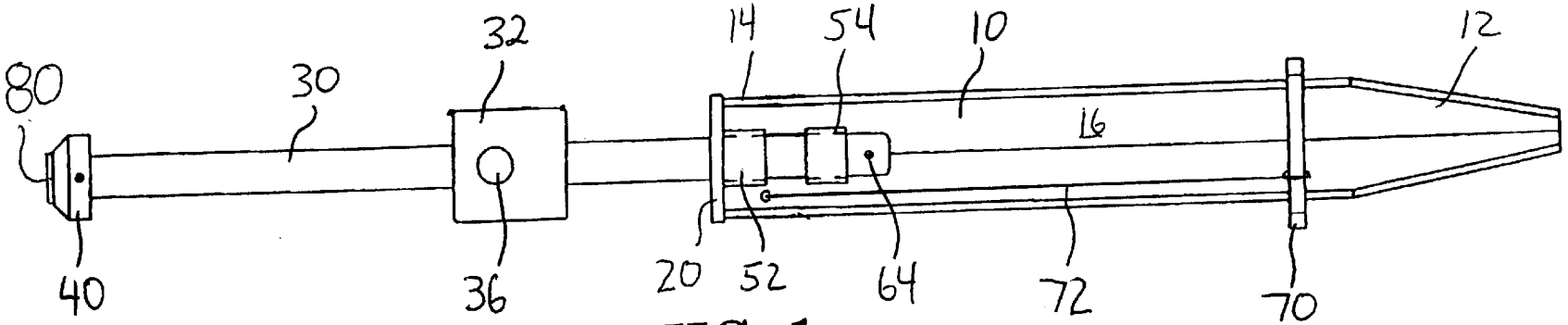
FIG. 1 illustrates in schematic view a collapsible land anchor in an operative position according to a presently preferred embodiment of the invention.
Figure 2:
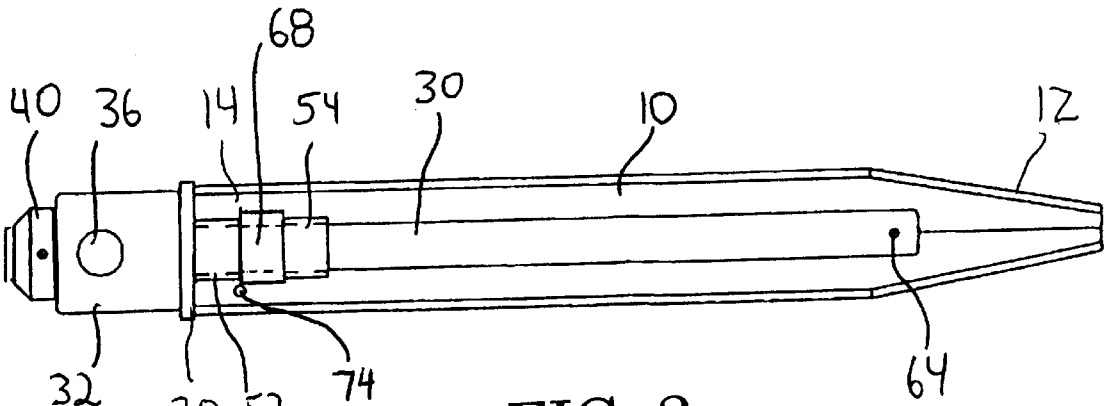
FIG. 2 is an illustration of the collapsible land anchor of FIG. 1 in schematic view, showing the anchor in a collapsed position.
Figure 3:
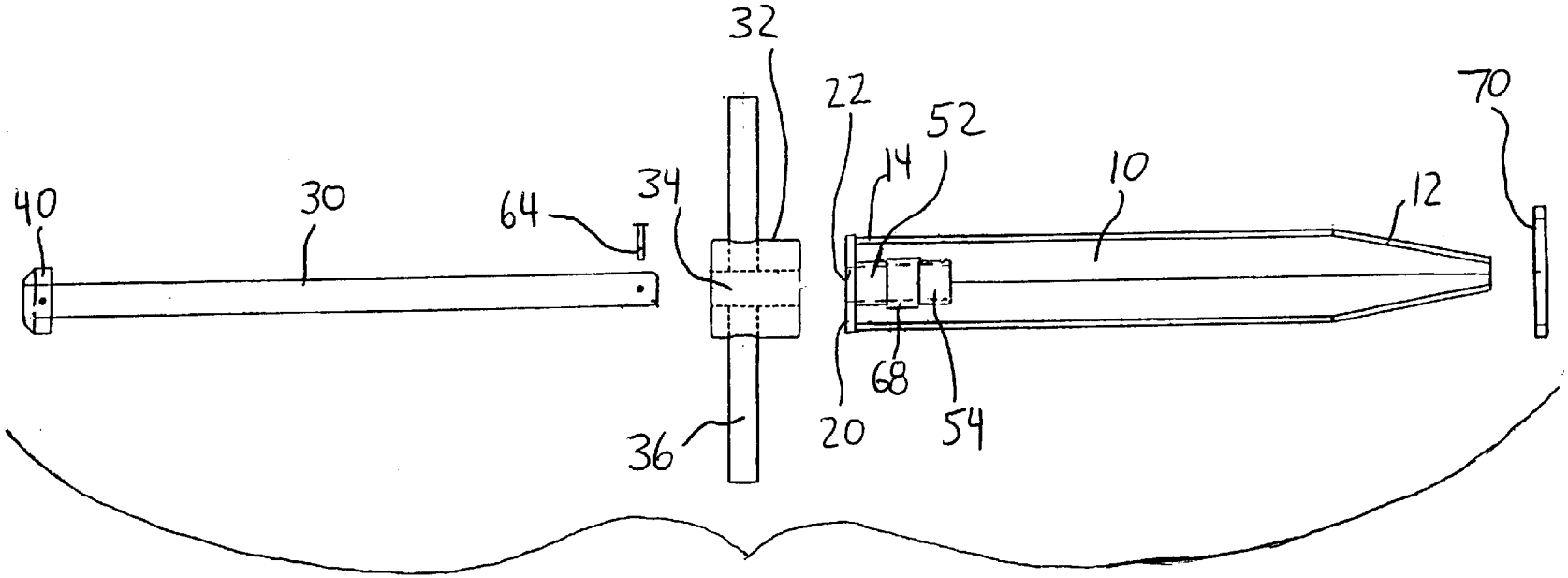
FIG. 3 is another illustration of the collapsible land anchor of FIG. 1, showing the anchor in an exploded schematic view.
Figure 4:
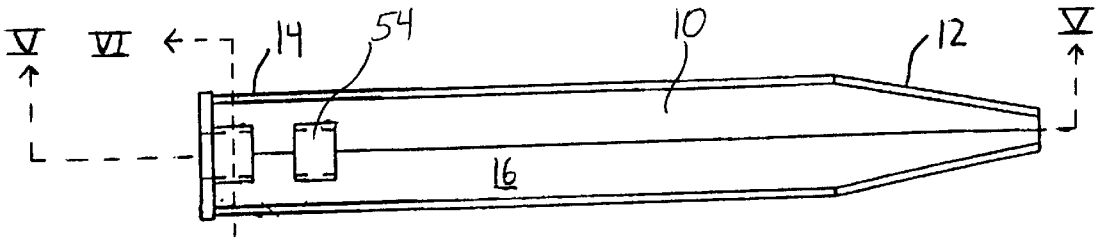
FIG. 4 is an isolated schematic view of the anchor body and collars of the collapsible land anchor of FIG. 1.
Figure 5:
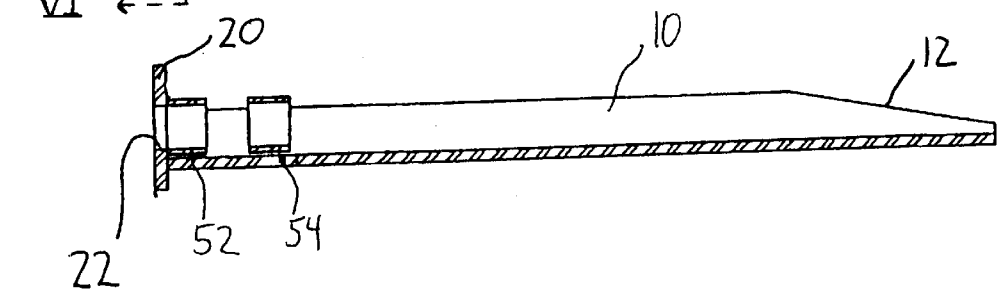
FIG. 5 is a side sectional view taken along sectional line V—V of FIG. 4.

As shown in FIGS. 1 and 2, the runner member 30 is capable of sliding longitudinally relative to the drive anvil 20 between an operative position shown in FIG. 1 and a stowed position shown in FIG. 2. The hammer 32 is carried on the runner member 30. Preferably the hammer weight 32 is annular in shape and has a bore 34 through which the runner member 30 is received, so that the hammer weight 32 is captive on the runner member 30. In the operative position, at least a portion of the length of the runner member 30 extends beyond the drive anvil 20 away from the cavity 16 of the anchor body 10 to space the drive anvil 20 apart from the retraction anvil 40 by a sufficient distance to allow sliding movement of the captive hammer weight 32 between the anvils 20 and 40. In the operative position, it is preferred for the majority of the length, and still more preferably at least 80 percent of the length, of the runner member 30 to extend beyond the drive anvil 20 and away from the cavity 16 of the anchor body 10. The hammer weight 32 may includes at least one graspable arm 36 or handle for facilitating sliding movement of the hammer weight. As shown in FIG. 3, the arms 36 are preferably diametrically opposed relative to each other, and are perpendicular to the axis of the runner member 30. The arms 36 may optionally be covered with a gripping material, such as a rubber sheath.

In the illustrated embodiment, the runner member 30 is moved from the operative position (FIG. 1) to the collapsed position (FIG. 2) by sliding the runner member 30 through the aperture 22 of the drive anvil 20. In the collapsed position, the runner member 30 is displaced towards the cavity 16 of the anchor body 10 relative to the operative position, so that at least a second portion of the length of the runner member 30 is stowed in the cavity 16 of the anchor body 10. In the collapsed position, it is preferred for the majority of the length, and still more preferably at least 80 percent of the length, of the runner member 30 to be accommodated in the cavity 16 of the anchor body 10. In the most preferred embodiment, the collapsed position is characterized by sandwiching of the hammer weight 32 between the retraction anvil 40 and the drive anvil 20 to prevent sliding movement of the hammer weight 32 along the runner member 30, as shown in FIG. 2.

Figure 8:
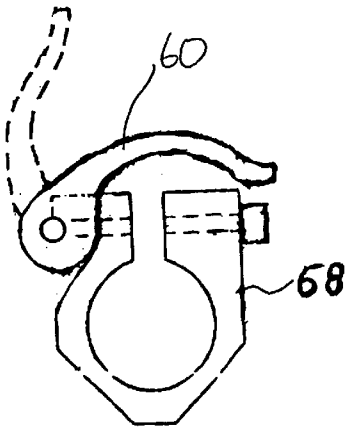
FIG. 8 is a plan schematic view of a locking mechanism shown in locked (solid lines) and unlocked (phantomed lines) positions in accordance with a preferred embodiment of the invention.

The preferred land anchor further comprises a locking mechanism 50 for retaining the runner member 30 in the operative and collapsed positions. As illustrated, the locking mechanism comprises a first collar 52 and a second collar 54 having respective passages that are coaxially aligned. (Although two collars are illustrated, it is to be understood that a single collar or more than two collars may be used.) The runner member 30 is received in the coaxially aligned passages of the collars 52 and 54. Referring to FIG. 8, a clamp 68 carrying a quick release lever 60 is interposed between the first collar 52 and the second collar 54. The clamp 68 is held captive on the runner member 30, which passes through a passage (unnumbered) of the clamp 68. When placed in its locked position, the quick release lever 60 decreases the size of the passage of the clamp 68 and immobilizes the runner member 30 relative to the anchor body 10. On the other hand, when unlocked, the quick release clamp 60 opens the passage of the clamp 68 by a sufficient degree to allow sliding movement of the runner member 30 through the clamp 68 (and adjacent collars 52 and 54) between the operative and collapsed positions.

A retention pin 64 extends from a bottom end portion (unnumbered) of the runner member 30 and is received in the cavity 16. The retention pin 64 functions to avoid unintentional disengagement of the runner member 30 from the anvil body 10 by preventing sliding movement of the bottom end portion of the runner member 30 past the collars 52 and 54, the clamp 68, and the drive anvil 20. If desired, the retention pin 64 may be removable to facilitate disassembly of the land anchor.

Figure 7:
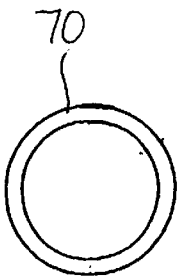
FIG. 7 is a plan schematic view of a rode-tying ring of the collapsible land anchor of FIG. 1.

As shown in FIGS. 1, 3, and 7, the land anchor may also optionally include a rode-tying ring 70. The rode-tying ring 70 is received around the periphery of the anchor body 10. In the illustrated embodiment, the rode-tying ring 70 is joined to the anchor body 10 via a lanyard 72. A first end of the lanyard 72 is attached to the rode-tying ring 70. A second end of the lanyard 72 is knotted through a hole 74 in the anchor body 10. The lanyard 72 is sufficiently short in length to prevent the rode-tying ring 70 from slipping over the tapered bottom end portion 12 of the anchor body 10.

In operation, the preferred land anchor works as follows. The land anchor is placed into the operative position illustrated in FIG. 1. The runner member 30 is locked into its extended or operative position by actuating the quick release lever 60. Actuation of the quick release lever 60 restricts the size of the passage of the clamp 68 and causes the clamp 68 to grasp the runner member 30. Longitudinal movement of the clamp 68, and hence the runner member 30, is prevented by the stationary collars 52 and 54 located on opposite sides of the clamp 68, thus immobilizing the runner member 30 relative to the anchor body 10.

The tapered bottom end portion 12 of the anchor body 10 is then placed in contact with the earth, or another stationary or stable object. The user may then grasp the arms 36 of the hammer weight 32, and thrust the hammer weight 32 along the runner member 30 and into striking contact with the drive anvil 20. As the hammer weight 32 is driven into the drive anvil 20, the anchor body 10 is embedded further into the ground. The hammer weight 32 may then be withdrawn towards the retraction anvil 40, and the thrusting and striking movements repeated until the anchor body 10 is embedded further into the earth, or other stationary or docking object. Once the anchor body 10 has been securely lodged, the rode-tying member 70 is placed in contact with the ground or moved in proximity to the ground, depending on the distance of movement that the length of the lanyard 72 allows. The rode or mooring line of a boat may be tied around the rode-tying member 70 of the land anchor to dock the boat. By positioning the rode-tying member 70 in proximity to the ground, the rode-tying member 70 provides higher resistance to dislodging due to pulling forces applied by a mooring line than if the mooring line had been attached to a higher point on the anchor.

Undocking may be accomplished by untying the rode from the rode-tying member 70, then removing the land anchor from the ground or stationary object. For example, the land anchor may be removed from the ground by pulling the hammer weight 32 towards the retraction anvil 40. In the event that the pulling force applied by the hammer weight 32 on the retraction anvil 40 is not sufficient to dislodge the land anchor, the hammer weight 32 may be repeatedly thrust along the runner member 30 and into striking contact with the retraction anvil 40 until the anchor body 10 is dislodged from the ground.

The following dimensions are provided by way of illustration and example, and are not intended to be limiting on the scope of this invention. The anchor body 10 may be characterized by a length of 20 inches, with the tapering portion extending about 5 inches. The angled walls **10*a* and 10*b* of the angle iron may have a maximum width of 2 inches and a thickness of 3/16 inch. The runner may be characterized by length of 20 inches, with approximately 17 inches extending from the drive anvil 20 when in the operative state, and a 7/8 inch diameter. The diameter of the drive anvil 20 may be approximately 3 inches or slightly less. A suitable weight for the hammer weight 32 may weigh about 6 to 8 pounds, for example. The inner diameter of the rode-tying ring 70** may be 3.75 inches. The anchor may be painted, such as powder coating steel parts, for ornamental and anti-rusting protective reasons.

It is to be understood that several variations and modifications may be made to the illustrated embodiment. Several possible variations and modifications have been discussed above. Other changes that may be made to the illustrated embodiment and fall within the scope of this invention include the following. The anchor body 10 may undertake a configuration other than the illustrated angle iron. For example, the anchor body 10 may be configured as a hollow tube having a cavity that surrounds the runner member 30 when the runner member is in the collapsed position. The tapered bottom end portion 12 of the tube can be cut at an oblique angle to provide an edge that facilitates driving of the anchor body 10 into the ground.

Another modification that can be made to the preferred embodiment comprises placement of the quick-release lever 60 on either of the collar members 52 or 54, or replacement of the quick-release lever 60 with another locking mechanism, such as a locking pin. For example, one of the collar members may be provided with a radial orifice, and the runner member may be provided with similar upper and lower radial orifices located in proximity to the upper and lower ends of the runner member, respectively. Locking of the land anchor into the operative position may then be accomplished by aligning the lower radial orifice of the runner member with the orifice of the collar member, and inserting the locking pin through the aligned orifices. On the other hand, locking of the land anchor into the collapsed position may then be accomplished by aligning the upper radial orifice of the runner member with the orifice of the collar member, and inserting the locking pin through the aligned orifices. This alternative embodiment is exemplary of the many variations and modifications to the locking mechanism that may fall within the scope of this invention.

Also, the lanyard 72 may be replaced by another part or parts having an equivalent function, such as flanges radially extending from the anchor body 10, for preventing disengagement of the rode-tying ring 70. It is also possible to weld or otherwise affix the rode-tying ring 70 to the anchor body.

Other modifications that may be practiced within the scope of this invention include making the arms 36 detachable from the hammer weight 32. For example, the arms 36 and hammer weight 32 may have complementary screw threads for engagement and disengagement by rotation of the arms 36 about their axes. The arms may also be jointed or articulated to permit their collapse into a more compact arrangement.

It should also be understood that several of the illustrated features are optional, such as the arms 36, the retention pin 64, rode-tying ring 70, and the lanyard 72, and may be omitted altogether. Further, it is within the scope of this invention for the land anchor to include additional components or parts, such as protective or decorative ornaments. Especially useful is the use of a bright light source 80, such as a battery operated LED, on land anchor for enhancing awareness of the land anchor to alter and prevent potential injury to persons in the vicinity of the land anchor. The LED may be placed on the end of the retraction anvil 40, as shown in FIGS. 1 and 2.

The land anchor of this invention may be used in applications other than for anchoring boats. For example, the land anchor may be used for tethering a leashed dog or other animal, tethering to a seaplane, such as a pontoon plane, or as the stake of a tent or other dwelling.

The foregoing detailed description of the preferred embodiments of the invention has been provided for the purposes of illustration and description, and is not intended to be exhaustive or to limit the invention to the precise embodiments disclosed. The embodiments were chosen and described in order to best explain the principles of the invention and its practical application, thereby enabling others skilled in the art to understand the invention for various embodiments and with various modifications as are suited to the particular use contemplated. It is intended that the scope of the invention cover various modifications and equivalents included within the spirit and scope of the appended claims.

What is claimed is:

1. A collapsible land anchor comprising:

an anchor body having a tapered bottom end portion and a top end portion, the anchor body provided with a cavity extending longitudinally between the tapered bottom end portion and the top end portion;

a drive anvil coupled to the top end portion of the anchor body;

a runner member having a length and slidable longitudinally across the drive anvil between an operative position, in which at least a first portion of the length of the runner member extends beyond the drive anvil away from the cavity of the anchor body, and a collapsed position, in which the runner member is displaced towards the cavity of the anchor body relative to the operative position and in which at least a second portion of the length of the runner member is stowed in the cavity of the anchor body;

a retraction anvil coupled to the top end portion of the runner member so as to be longitudinally spaced apart from the drive anvil when the runner member is in the operative position;

a hammer weight slidable along the runner member between the drive anvil and the retraction anvil when the runner member is in the operative position; and a locking mechanism constructed and arranged to lock the runner member in the operative position.

2. A collapsible land anchor according to claim 1, wherein the tapered bottom end portion is truncated.

3. A collapsible land anchor according to claim 1, wherein the anchor body comprises first and second walls connected to each other to define a V-shape cross section.

4. A collapsible land anchor according to claim 1, wherein the anchor body comprises an angle iron.

5. A collapsible land anchor according to claim 1, wherein the cavity is open.

6. A collapsible land anchor according to claim 1, wherein the drive anvil has an aperture.

7. A collapsible land anchor according to claim 6, wherein the runner member is slidable through the aperture of the drive anvil.

8. A collapsible land anchor according to claim 7, wherein the aperture comprises a circular hole.

9. A collapsible land anchor according to claim 1, wherein the runner member has a tubular configuration.

10. A collapsible land anchor according to claim 1, wherein in the operative position a majority of the length of the runner member is located outside of the cavity of the anchor body, and wherein in the collapsed position the majority of the length of the runner member is stowed in the cavity of the anchor body.

11. A collapsible land anchor according to claim 1, wherein in the operative position at least 80 percent of the length of the runner member is located outside of the cavity of the anchor body, and wherein in the collapsed position at least 80 percent of the length of the runner member is stowed in the cavity of the anchor body.

12. A collapsible land anchor according to claim 1, wherein the runner member comprises stainless steel.

13. A collapsible land anchor according to claim 1, wherein the runner member comprises aluminum.

14. A collapsible land anchor according to claim 1, wherein in the collapsed position, the hammer weight is sandwiched between the retraction anvil and the drive anvil to prevent sliding movement of the hammer weight along the runner member.

15. A collapsible land anchor according to claim 1, wherein the hammer weight has an annular cross section and is engaged around the runner member.

16. A collapsible land anchor according to claim 1, further comprising diametrically opposed arms extending from the hammer weight.

17. A collapsible land anchor according to claim 1, wherein the locking mechanism comprises:

first and second collar members longitudinally spaced apart from each other and defining respective passages that are coaxially aligned and through which the runner member passes;

a clamp interposed between the first and second collar members and having a clamp passage through which the runner member passes; and a clamping mechanism in operative association with the clamp for decreasing the size of the passage of the clamp for grasping of the runner member.

18. A collapsible land anchor according to claim 17, wherein the clamping mechanism comprises a quick release lever.

19. A collapsible land anchor according to claim 1, further comprising a retention pin extending from a bottom end portion of the runner member and retained in the cavity, wherein the retention pin is arranged to prevent sliding movement of the bottom end portion of the runner member through the aperture of the drive anvil.

20. A collapsible land anchor according to claim 1, further comprising:

a rode-tying ring extending around the anchor body and movable longitudinally along a portion of the anchor body; and a lanyard having a first end attached to the rode-tying ring and a second end attached to another part of the collapsible land anchor, wherein the lanyard has a sufficient short length to prevent the rode-tying ring from slipping over the tapered end portion of the anchor body.

21. A collapsible land anchor according to claim 1, further comprising an LED positioned on the retraction anvil.

22. A collapsible land anchor comprising:

an anchor body having a tapered bottom end portion and a top end portion, the anchor body provided with a cavity extending longitudinally between the tapered bottom end portion and the top end portion;

a drive anvil coupled to the top end portion of the anchor body;

a runner member having a length and slidable longitudinally across the drive anvil between an operative position, in which at least a first portion of the length of the runner member extends beyond the drive anvil away from the cavity of the anchor body, and a collapsed position, in which the runner member is displaced towards the cavity of the anchor body relative to the operative position and in which at least a second portion of the length of the runner member is stowed in the cavity of the anchor body;

a retraction anvil coupled to the top end portion of the runner member so as to be longitudinally spaced apart from the drive anvil when the runner member is in the operative position;

a hammer weight slidable along the runner member between the drive anvil and the retraction anvil when the runner member is in the operative position; and a locking mechanism constructed and arranged to lock the runner member in the operative position and the collapsed position.

23. A land anchor comprising:

an anchor body having a tapered bottom end portion and a top end portion;

a drive anvil coupled to the top end portion of the anchor body;

a runner member;

a retraction anvil coupled to the top end portion of the runner member and longitudinally spaced apart from the drive anvil;

a hammer weight slidable along the runner member between the drive anvil and the retraction anvil;

a rode-tying ring extending around the anchor body and movable longitudinally along a portion of the anchor body; and a lanyard having a first end attached to the rode-tying ring and a second end attached to another part of the collapsible land anchor, wherein the lanyard has a sufficient short length to prevent the rode-tying ring from slipping over the tapered end portion of the anchor body.

24. A collapsible land anchor according to claim 1 in combination with a boat, further comprising a rode connecting the boat to the collapsible land anchor.

* * * * *

UNITED STATES PATENT AND TRADEMARK OFFICE

CERTIFICATE OF CORRECTION

PATENT NO. : 6,606,829 B2 
DATED : August 19, 2003
INVENTOR(S) : Frank Benincasa and Benjamin Cafaro It is certified that error appears in the above-identified patent and that said Letters Patent is hereby corrected as shown below:

Title page,
Item [75], Inventor, "Beneditto Cafaro" should read -- Benjamin Cafaro --.

Signed and Sealed this

Eighteenth Day of May, 2004

JON W. DUDAS
*Acting Director of the United States Patent and Trademark Office*